US006731902B2

(12) United States Patent
Takenaka et al.

(10) Patent No.: US 6,731,902 B2
(45) Date of Patent: May 4, 2004

(54) FIXING DEVICE AND IMAGE FORMING DEVICE

(75) Inventors: Kohta Takenaka, Kanagawa-Ken (JP); Masahiko Kamijoh, Kanagawa-Ken (JP); Hidehiko Fujiwara, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/245,767

(22) Filed: Sep. 18, 2002

(65) Prior Publication Data

US 2003/0063934 A1 Apr. 3, 2003

(30) Foreign Application Priority Data

Sep. 19, 2001 (JP) ..... 2001-285122

(51) Int. Cl.[7] ..... G03G 15/20

(52) U.S. Cl. ..... 399/333; 399/328; 399/330; 219/216

(58) Field of Search ..... 399/67, 68, 324, 399/328, 330, 331, 333; 219/216

(56) References Cited

U.S. PATENT DOCUMENTS 5,918,097 A * 6/1999 Kagawa et al. ..... 399/333

FOREIGN PATENT DOCUMENTS

| | | |
|---|---|---|
| JP | 8-262893 | 10/1996 |
| JP | 9-185279 | 7/1997 |
| JP | 9-212011 | 8/1997 |
| JP | 3005028 | 11/1999 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

A fixing device for a printing device is provided. The fixing device comprises a fixing unit, heated by a heating source; and a sheet-shaped pressure unit, having an elasticity and in contact with the fixing unit by pressing against the fixing unit. When a recording paper that a toner image has been transcribed thereon passes through a nip portion between the sheet pressing unit and the fixing unit, by pressing and heating, the toner image is fixed on the recording paper. In addition, a surface layer is formed on a surface of the fixing unit, wherein the surface layer comprises a material such as a glass fiber, a graphite, a bronze etc, for increasing a friction coefficient. Further, the surface has a water contact angle greater than or equal to 90°. By setting the friction coefficient of the surface of the fixing roller to a range that the toner does not adhere thereon, the transporting property of the recording paper can be improved.

10 Claims, 3 Drawing Sheets

FIXING DEVICE AND IMAGE FORMING DEVICE

CROSS-REFERENCE TO RELATED APPLICATION

This application claims the priority benefit of Japanese application serial no. 2001-285122 filed on Sep. 19, 2001.

BACKGROUND OF THE INVENTION

1. Field of the Invention

This invention relates generally to a fixing device and an image forming device, which can be used in a facsimile device, a printer, a copier, or a multi-function machine with the above functions.

2. Description of Related Art

FIG. 3, is a side view showing an internal structure of a facsimile apparatus comprising a conventional fixing device and a conventional image forming device. The facsimile apparatus comprises a facsimile main body 1, a process cartridge 2, a photo-sensing unit 3 having the process cartridge, an optical writing device 4, a paper-feeding cassette 5 for storing the recording paper, a paper-feeding roller 6 for feeding the recording paper from the paper-feeding cassette 5, a transcribing roller 7, a fixing device 8 consisting of a fixing roller 9 and a pressure roller 10, which is used for fixing the toner image onto the recording paper, an ejecting roller 11, a sealed sensor 12, and a document stage 13 disposed above the facsimile main body 1. The process cartridge 2 comprises various processing devices for performing the image formation by an electronic photographic process, and is detachable from the facsimile main body 1. The optical writing device 4 makes the photo-sensing unit 3 to scan by using a laser beam that is modulated based on the image data. The transcribing roller 7 is in contact with the photo-sensing unit 3 for transcribing the toner image formed on the photo-sensing unit 3 onto the recording paper.

The document placed on the document stage 13 is passed through the surface of the sealed sensor 12 by a transport system, and then ejected out into an external document stage. As the document passes through the surface of the sealed sensor 12, the image on the document is optically read by the sealed sensor 12. The image data, which is read by the sealed sensor 12 or input from an external source, is transmitted to the optical writing device 4. Based on the image data, the optical writing device 4 emits a modulated laser beam to the surface of the uniformly charged photo-sensing unit 3, so that an electrostatic latent image is formed on the surface of the photo-sensing unit 3. Then, the toner is made to adhere to the electrostatic latent image to form a toner image, and the toner image is transcribed onto the recording paper by the transcribing roller 7. As the recording paper passes through a nip portion between the fixing roller 9 and the pressure roller, by pressing and heating from the fixing device 8, the toner image is fixed onto the recording paper. Next, the recording paper is ejected out into an external document plate by the paper-ejecting roller 9.

Conventionally, an infrared heater or a halogen heater is used as the fixing heater in the fixing device. A structure constituting a fuser roller and a pressure roller pair is most commonly used in the conventional art. Typically, a conventional pressure roller is constructed by forming a silicon rubber layer on a core bar and then forming a mold-releasing layer (such as a tube made of fluorine resin) on the silicon rubber layer, so that the thermal capacity of the pressing roller can be increased. At the beginning of a heating process, the pressure roller does not get warmed-up easily, which causes incomplete fixing problems.

Instead of the pressure roller, a nip portion is formed by pressing a sheet-shaped pressure unit to be in contact with the fixing roller. For example, a fixing device for fixing an un-fixed image onto the recording paper by making the recording paper to pass through the nip portion is well studied and researched. Therefore, the sheet can be easily warmed up, and the heating efficiency can be higher compared to the device using a pressure roller.

A sheet shaped pressure unit is also used for applying pressure onto the recording paper. But the sheet-shaped pressure unit is not elastic, therefore causes a loading weight on the recording paper as the recording paper passes through the fixing device. It is preferred that the sheet-shaped pressure unit has a thermal resistance and a surface having less friction. On the other hand, in fixing device, in order to stabilize and effectively transport the recording paper, the surface of the fixing device, which a friction force is created thereon, can provide a transporting force. But, as the surface of the fixing roller becomes rougher, the toner is easily adhered on the surface of the fixing roller.

SUMMARY OF THE INVENTION

Accordingly, it is an object of the present invention is to provide a fixing device and an image forming device, which eliminate or substantially reduce the foregoing problems described above. Specially, this invention provides a fixing device with a capability of reducing the toner's adhesion onto the fixing roller and also capable of improving the transportation of the recording paper.

In order to achieve the above object and other objects of the present invention, a fixing device is provided. The fixing device comprises a fixing unit, heated by a heating source; and a sheet-shaped pressure unit, having elastic characteristics and in contact under a pressure with the fixing unit. In operation, as a recording paper with a toner image transcribed thereon passes through a nip portion between the sheet-shaped pressure unit and the fixing unit, due to pressing and heating effects, the toner image is fixed onto the recording paper. In addition, a surface layer is formed on a surface of the fixing unit, wherein the surface layer comprises a material capable of increasing a friction coefficient. Further, the surface layer has a water contact angle as a wettability, which is greater than or equal to 90°, therefore the wettability of the surface layer is small. Because the surface friction coefficient of the fuser roller is increased, therefore when the recording paper with a transcribed toner image passes between the fixing unit and the sheet-shaped pressure unit, a transporting force can be effectively created at a front end of the recording paper. Thus, the recording paper can pass firmly. Furthermore, because the water contact angle is above 90°, the toner adhesion onto the fixing roller surface can be effectively reduced.

Additionally, according to one aspect of the present invention, the surface layer is formed by PTFE having a glass fiber, a graphite, or a bronze, filled therein. By using this structure, the surface friction coefficient of the fixing roller can be increased.

The invention further provides an image forming device, which comprises the above fixing device. By using this structure, the transporting property of the recording paper can be improved.

BRIEF DESCRIPTION OF THE DRAWINGS

While the specification concludes claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

The embodiment of the invention is described in detail with reference to the following attached drawing.

Figure 1:
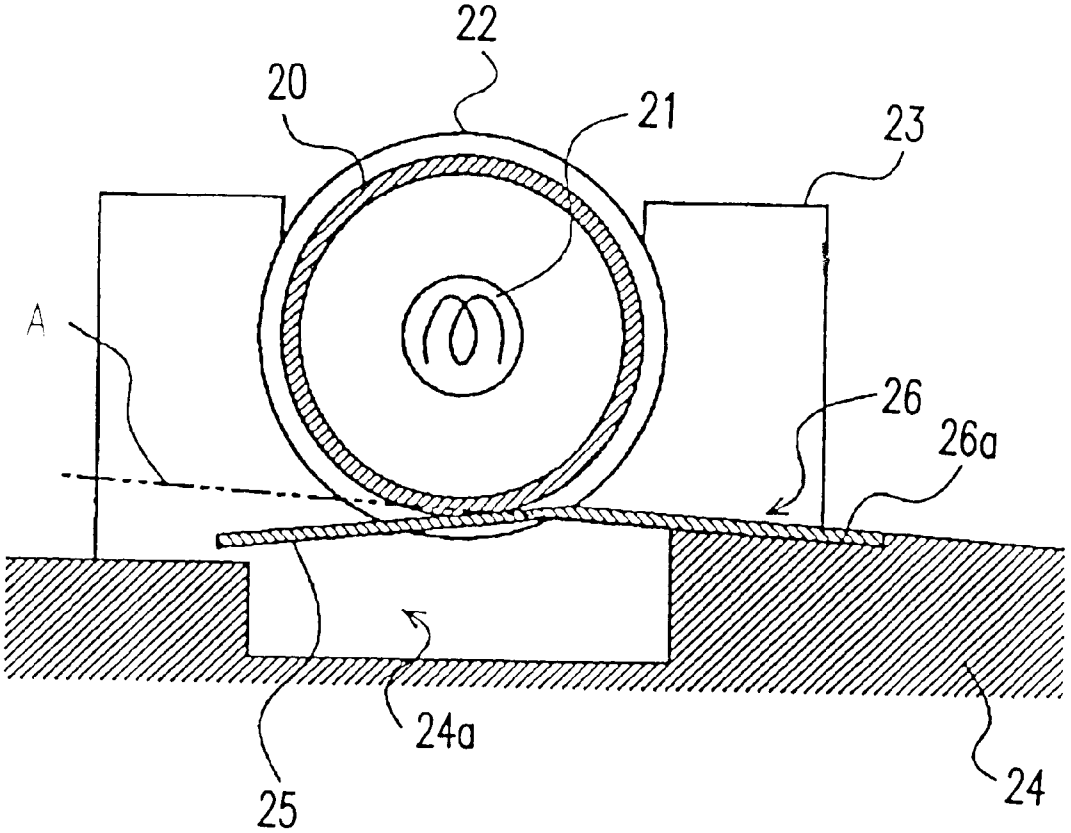
FIG. 1 is a side view showing a structure of a fixing device according to a preferred embodiment of the invention.
Figure 2:
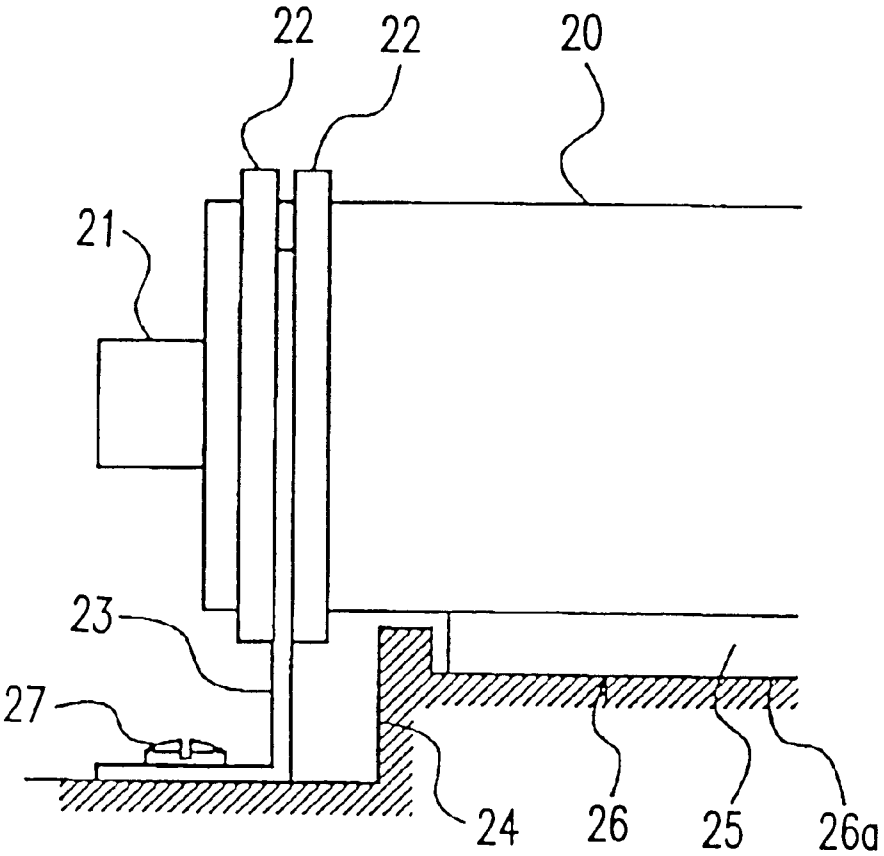
FIG. 2 is a front view of FIG. 1.

FIG. 1 shows a side view structure of the fixing device according to a preferred embodiment of the present invention, and FIG. 2 shows a front view of FIG. 1. Referring to FIGS. 1 and 2, a fuser roller 20, a heating source 21, for the fuser roller 20 (the heating source 21 can be arranged inside the fuser roller 20), bearings 22, disposed on two ends of the fixing roller 20, fitting elements 23, a base 24, a sheet-shaped pressure unit 25, an installation fitment 26, of the sheet-shaped pressure unit 25 for securing the fitting element 23 onto the base 24. A surface coating layer, which uses polytetrafluoethylene (PTFE) as the base material, is formed on the surface of the fixing roller 20. The sheet-shaped pressure unit 25 is formed by a heat-resistant material having a resistance against the fixing temperature, such as fluorine resin (PFA, PTFE, or FEP, etc.), or polyimide, etc.

A recess 24*a* is located in the base 24 at a position opposite to the fixing roller 20. A step-like installation fitment 26 is formed at an edge of the upstream side in the recording paper transporting direction of the recess 24*a*. When the base 24 is formed by molding, a guiding unit for guiding the back side of the recording paper from a transcribing roller 7 to the fixing roller 20, the recess 24*a*, and the installation fitment 26 are also formed at the same time.

The step portion of the installation fitment 26 is in contact with one end of the sheet-shaped pressure unit 25. The sheet-shaped pressure unit 25 is cantilever-supported on the installation fitment 26, so that one end of the sheet-shaped pressure unit 25 is closely fixed on the installation plane 26*a* by a two-side adhesive tape, and the other end of the sheet-shaped pressure unit 25 is a free end and is capable of moving upwards and downwards.

The fitting elements 23 are secured to the base 24 by using screws 27 in the downstream side of the recording paper transporting direction with respect to the installation fitment 26. As shown in FIG. 2, by supporting the fitting element 23 in between the bearings 22 of the fixing roller 20, the fixing roller 20 can be mounted within a main body of an image forming device. The installation fitment 26 is formed on the base 24, so that a plane containing the installation plane 26*a* crosses under the fixing roller 20. By closely affixing the sheet-shaped pressure unit 25 to the installation fitment 26, the sheet-shaped pressing unit 25 is cantilever-supported along the plane A containing the installation plane 26*a*. In this embodiment, the installation plane 26*a* is formed in a such a manner that the sheet-shaped pressure unit 25 is inclined upwards.

Therefore, when mounting the fixing roller 20, the fixing roller 20 is in contact with and presses against the sheet-shaped pressure unit 25, so that the fixing roller 20 and the sheet-shaped pressure unit 25 touch each other under a pressure. A pressure is applied by the sheet-shaped pressure unit 25 onto the fixing roller 20, which is comparable to a nip pressure. The elasticity of the sheet varies depending upon the thickness and/or the material of the sheet-shaped pressure unit 25, accordingly, the fitting position of the fixing roller can be set to meet a desired nip pressure for achieving desired features of the sheet-shaped pressure unit 25. In addition, when mounting the fixing roller 20, the free end of the sheet-shaped pressure unit 25 can be near or in contact with the step portion of the recess 24*a* in the recording paper transporting direction with respect to the nip portion.

Figure 3:
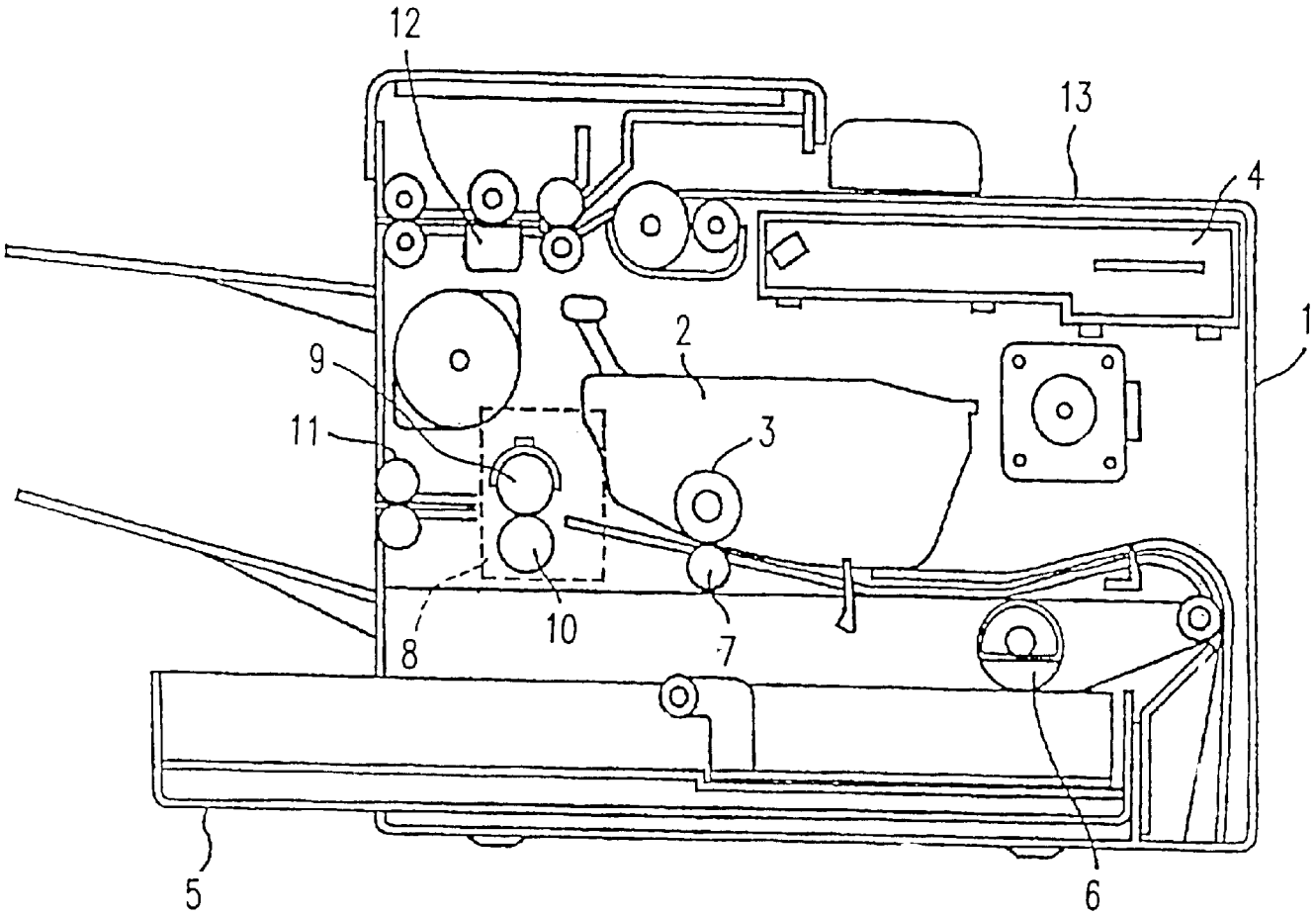
FIG. 3 (PRIOR ART)
FIG. 3 is a side view showing an internal structure of a facsimile apparatus comprising a conventional fixing device and a conventional image forming device.

The operation according to a preferred embodiment of the present invention is described in detail in the following description. Transport mechanism for transporting a recording paper where the toner image has been transcribed thereon to the fixing device, is same as the conventional art as shown in FIG. 3. The recording paper carrying the toner image passes the nip portion in between the fixing roller 20 and the sheet-shaped pressure unit 25 of the fixing device, and then, by pressing and heating, the toner image is fixed onto the recording paper. Afterwards, the recording paper is ejected out and into an external document plate by the paper-ejecting roller 11.

To resolve the foregoing problems from using a conventional device as substantially described above, this invention provides a sheet-shaped pressure unit 25, which is resistant to the fixing temperature of the fuser roller 20 and which has a surface having less friction. Furthermore, the surface of the fixing roller 20 is designed to provide a friction to effectively create a transporting force.

According to one aspect of this invention, a material capable of increasing the friction coefficient is added to the base material forming the surface layer of the fixing roller 20, so that a water contact angle is greater than or equal to 90°, and therefore the wettability of the surface layer is small, thus, the toner adhesion onto the surface of the fuser roller 20 can be effectively reduced or eliminated.

Following are several examples of materials that can be used for making the surface layer of the fixing roller 20. Four different surface layers, for example, a pure PTFE layer, a PTFE layer comprising 20% of glass fiber, a PTFE layer comprising 15% of graphite, and a PTFE layer comprising 60% of bronze, are used and compared. The static friction coefficient and kinetic friction coefficient are calculated and the results are shown in Table I, wherein P indicates the loading weight (expressed in Mega Pascal unit) and V is the speed of the transportation.

TABLE I

| | Operation condition | Pure PTFE layer | PTFE layer comprising 20% glass fiber | PTFE layer comprising 15% graphite | PTFE layer comprising 60% bronze |
|---|---|---|---|---|---|
| Static friction coefficient | P = 3.5 MP | 0.05–0.08 | 0.10–0.13 | 0.08–0.10 | 0.08–0.10 |
| Kinetic friction coefficient | P = 0.7 MP<br>V = 0.5 m/sec | 0.13 | 0.29–0.35 | 0.22–0.25 | 0.12–0.17 |

As shown in Table I, the static friction coefficient for the pure PTFE layer (without any other material) is lower compared to the PTFE layers comprising 20% glass fiber, 15% graphite and 60% bronze materials, as shown above. Because the static friction coefficient is largely dependent upon the composition of the surface layer as exemplified in Table I, therefore, by adjusting the composition of the surface layer using PTFE as a base material, a surface layer with a desired static friction coefficient can be achieved. Because the present invention uses a special surface layer to increase the surface friction coefficient instead of increasing the pressure, therefore roughening of the surface of the fuser roller can be effectively reduced, thus adhesion of the toner onto the surface of the fuser can be effectively reduced. As the front end of the recording paper enters the nip portion, because a transporting force from the fuser roller 20 of the present invention is applied to the front end of the recording paper, therefore, the occurrence of paper jam can be effectively reduced and the recording paper can pass the nip portion firmly.

According to the present invention as described above, the adhesion of the toner onto the fuser roller does not occur and the friction force of the fixing roller surface can be effectively increased. Therefore, the transport of the recording paper can be improved.

While the present invention has been described with a preferred embodiment, this description is not intended to limit our invention. Various modifications of the embodiment will be apparent to those skilled in the art It is therefore contemplated that the appended claims will cover any such modifications or embodiments as fall within the true scope of the invention.

What claimed is:

1. A fixing device, comprising:

a base having a recess portion;

a fixing unit connected to the base, and heated by a heating source, wherein the fixing unit includes a surface layer on a surface of the fixing unit, the surface layer comprising a material for increasing a friction coefficient, and wherein the surface layer has a water contact angle greater than or equal to 90°; and a sheet-shaped pressure unit, having an elasticity and in contact with the fixing unit by pressing against the fixing unit, and cantilevered at a first end over the recess portion in the base;

wherein when a recording paper onto which a toner image has been transcribed passes through a nip portion between the sheet-shaped pressure unit and the fixing unit, by pressing and heating, the toner image is fixed onto the recording paper.

2. The fixing device of claim 1, wherein the surface layer is formed by PTFE filled with a glass fiber.

3. The fixing device of claim 1, wherein the surface layer is formed by PTFE with a graphite.

4. The fixing device of claim 1, wherein the surface layer is formed by PTFE with a bronze.

5. The fixing device of claim 3, wherein the base includes a step-shape installation fitment into which a second end of the sheet-shaped pressure unit is secured.

6. An image forming device, comprising:

a fixing device comprising:

a base having a recess portion;

a fixing unit connected to the base, and heated by a heating source, wherein the fixing unit includes a surface layer on a surface of the fixing unit, the surface layer comprising a material for increasing a friction coefficient, and wherein the surface layer has a water contact angle greater than or equal to 90°; and a sheet-shaped pressure unit, having an elasticity and in contact with the fixing unit by pressing against the fixing unit, and cantilevered at a first end over the recess portion in the base;

wherein when a recording paper onto which a toner image has been transcribed thereon, passes through a nip portion between the sheet-shaped pressure unit and the fixing unit, by pressing and heating, the toner image is fixed onto the recording paper.

7. The image forming device of claim 6, wherein the surface layer is formed by PTFE filled with a glass fiber.

8. The image forming device of claim 6, wherein the surface layer is formed by PTFE with a graphite.

9. The image forming device of claim 6, wherein the surface layer is formed by PTFE with a bronze.

10. The image forming device of claim 6, wherein the base includes a step-shape installation fitment into which a second end of the sheet-shaped pressure unit is secured.

* * * * *